US005603265A

United States Patent [19]

Jones

[11] Patent Number: 5,603,265

[45] Date of Patent: Feb. 18, 1997

[54] ANGLED TRACTION RODS

[75] Inventor: Philip A. Jones, Boise, Id.

[73] Assignee: M-K Rail Corporation, Boise, Id.

[21] Appl. No.: 399,944

[22] Filed: Mar. 6, 1995

[51] Int. Cl.[6] ..... B61F 5/00

[52] U.S. Cl. ..... 105/167; 105/166; 105/218.2; 105/222

[58] Field of Search ..... 105/136, 165, 105/166, 168, 172, 196, 218.1, 167, 218.2, 222

[56] References Cited

U.S. PATENT DOCUMENTS 4,285,280 8/1981 Smith ..... 105/168
4,679,507 7/1987 Rassaian ..... 105/166 X
4,765,250 8/1988 Goding ..... 105/166
5,375,533 12/1994 Schwendt ..... 105/166

*Primary Examiner*—Mark T. Le
*Attorney, Agent, or Firm*—Frank J. Dykas

[57] ABSTRACT

A self-steering wheel truck for use with a railway locomotive or powered transit car in which tractive force is transferred from the axle to the frame through angled traction rods and steering beams connecting with the end axles. The steering beams interconnect the end axles so that the yaw of one axle induces an equal and opposite rotation of the other end axle. The traction rods are aligned at an angle with respect to the longitudinal axis of the truck. The angled traction rod arrangement induces a force tending to return a laterally displaced axle back to center, thereby minimizing hunting while at the same time permitting self steering axle yaw action.

4 Claims, 6 Drawing Sheets

ANGLED TRACTION RODS

BACKGROUND OF THE INVENTION

1. Technical Field

This invention relates to railway vehicles and steering trucks therefor. More particularly, this invention relates to railway locomotives and motorized self-steering radial trucks for locomotive use.

2. Background

Conventional railway truck designs comprising a pair of laterally spaced side frames and a transom extending transversely there between have become the standard in many railway industry applications. These trucks include axle and wheel assemblies which rotatably support the frame by means of bearing housings at the ends of the axles. Problems encountered with these conventional trucks include the tendency for the wheel sets to traverse curves in a non-radial orientation and with much wheel flange to rail rubbing contact. Furthermore, the wheel sets may tend to slide during negotiation of track curves. Such rubbing contact and wheel sliding result in undesirably high wheel and rail wear, and the flange rubbing in particular may produce a tendency for the wheel to climb the rail. In addition, improper wheel set tracking in curves may result in track misalignment.

Other related problems occur when conventional trucks traverse straight or tangent runs of track. For example, a rigid wheel axle set, having conventional tapered conical wheels, when displaced laterally from the center line of a run of straight track, executes two simultaneous motions; first, the wheel set moves toward its equilibrium (center) position under the influence of gravity, and secondly, the high side wheel, rolling on a larger diameter than the low side wheel, moves along the rail faster than its partner, causing the wheel set to yaw. Given the proper set of circumstances, this motion may become a sustained harmonic oscillation known as hunting. The hunting tendency is transmitted to the truck and causes an oscillatory yawing motion of the truck about its center of rotation, resulting in additionally high wheel and rail forces and wear.

These problems have been recognized in the prior art and a variety of self steering railway truck designs which purport to allow the wheel sets to track without sliding and without undue flange rubbing during negotiation of curves, and with minimal adverse consequences resulting from hunting. These designs typically mechanically couple the two end axles of the truck through traction rods pivotally connected to the axle bearing housings so that when curved track operation induces a rotation, or yaw, of one axle, a mechanical linkage including the traction rods induces an opposite yawing of the trailing truck axle. In this way, the wheel sets more closely track the curvature of the track and wheel and track wear is minimized.

One example is Goding, U.S. Pat. No. 4,765,250, which teaches a method for inducing an "equal and opposite" rotation, or yaw, of one truck axle in response to the yawing of another truck axle when the truck is encountering a curve. Four traction rods, pivotally connected to the bearing housings of the two axles, connected at their other ends to two transversely mounted steering beams, and aligned generally parallel to the truck longitudinal axis, transmit the tractive force to a lower end of respective vertical shafts. Attached to the top of each of the vertical shafts are opposing crank arms which themselves are interconnected by a diagonal link. As one axle yaws, that yawing motion is transmitted via the traction rods, steering arms, vertical shafts, crank arms and diagonal link to induce an opposite yawing motion in the other axle.

A major problem with self-steering railway truck designs is that freeing the axles so that they may yaw and allow the wheel sets to more closely follow the track curvature, and thereby minimize wheel flange and track wear, at the same time permits the axle and wheel sets additional lateral displacement freedom, thereby increasing the potential for truck hunting. In other words, the objectives of wheel set self-steering and truck hunting minimization work are conflicting. One approach to this problem has involved rigidizing the truck frame, in addition to using resilient pads between the truck framing and the axle and wheel sets, thereby inhibiting lateral displacement of the axle and wheel sets. This arrangement still allows a limited measure of self steering of the axle and wheel sets. However, often there is only limited suppression of truck hunting while self steering is compromised.

Accordingly, the object of this invention is to provide a self-steering railway truck in which hunting, with its concomitant adverse affects, is minimized, by inhibiting wheel set lateral displacement.

Another object of this invention is to provide a self-steering railway truck in which hunting is minimized while permitting self-steering axle yaw action.

DISCLOSE OF INVENTION

These and other objects are accomplished by an improvement to self-steering railway trucks, in which traction rods generally parallel to the longitudinal axis of the truck frame are replaced by traction rods which form an angle with the longitudinal truck axis. Such self-steering railway trucks have steering beams pivotally connecting end axles via traction rods and fixably attached at their centers to upstanding tractive force shafts pivotally mounted on adjacent transoms. The force shafts each carry a control arm, the control arms being connected by at least one diagonally crossing arm. According to this invention, the generally longitudinal traction rods are replaced by traction rods which are angled with respect to the truck longitudinal axis. This angled traction rod configuration gives the wheel and axle sets increased lateral stability, thereby minimizing hunting, while permitting unhindered self-steering axle yaw action. These and other features and advantages of the invention will be more fully understood in the following description of a preferred embodiment of the invention, taken together with the accompanying drawings.

BEST MODE FOR CARRYING OUT INVENTION

Figure 1:
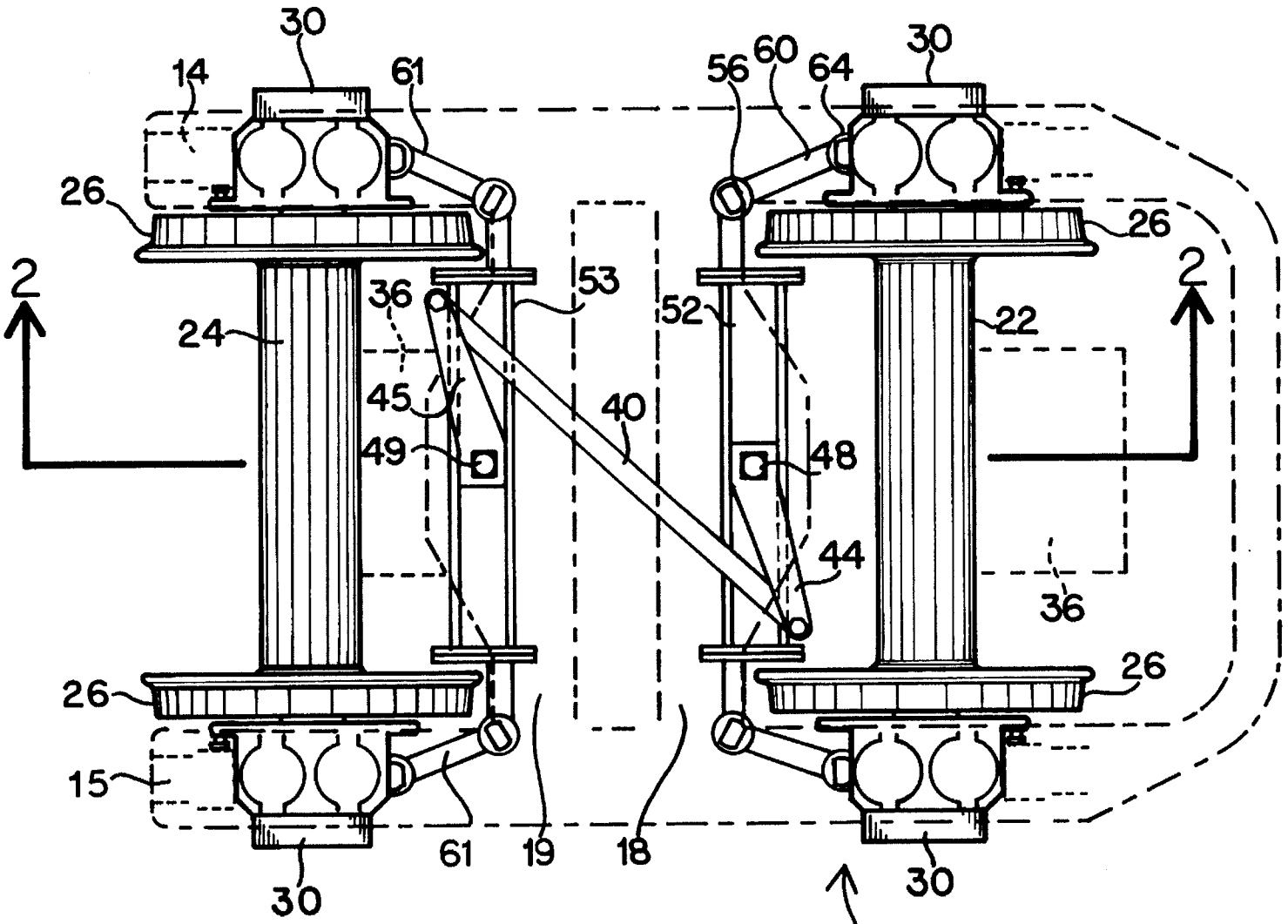
FIG. 1 is a is a top plan representational view of a two axle self-steering motorized railway truck with features in accordance with the present invention with parts broken away for clarity.
Figure 2:
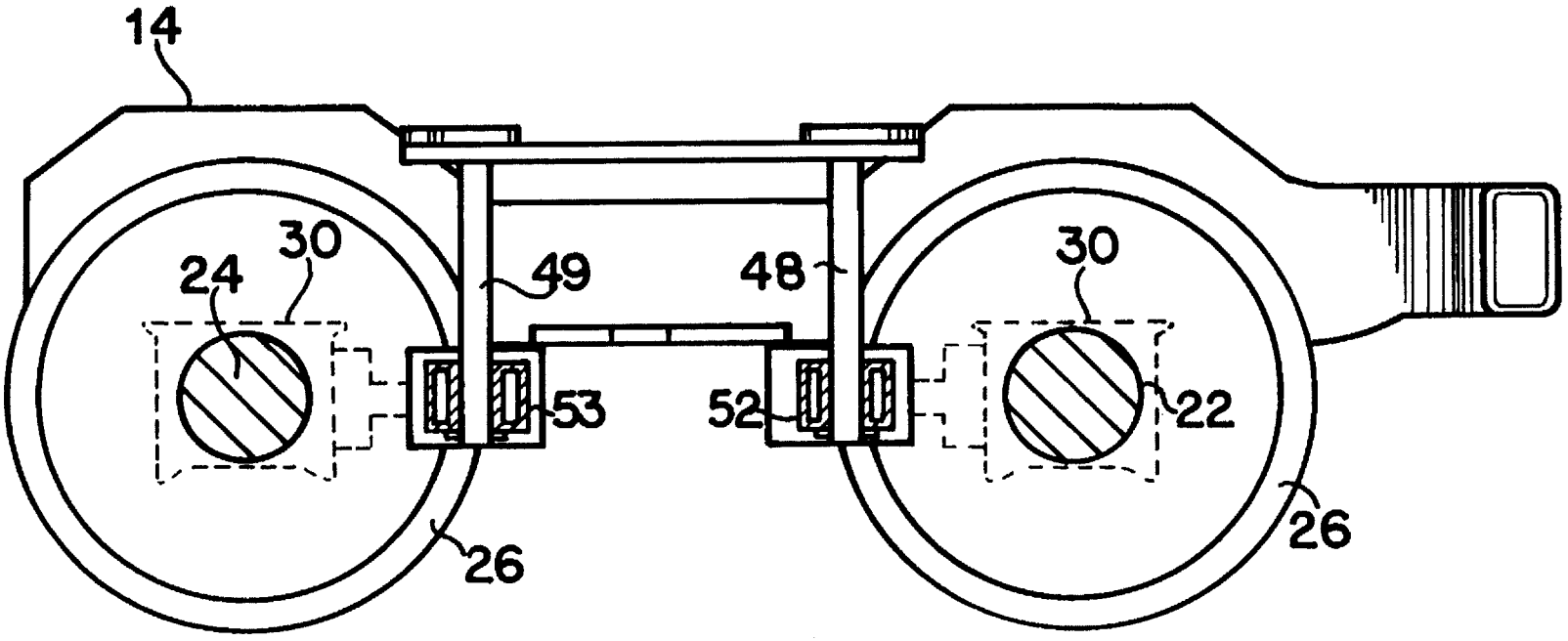
FIG. 2 is a side cross sectional representational view through line 1—1 of the truck of FIG. 1 with parts broken away for clarity.

The invention may be embodied in rail trucks having various numbers of axles. Referring now to FIGS. 1 and 2, numeral 10 generally indicates the two axle self steering railway truck of this invention. The truck 10 includes a pair of generally parallel laterally spaced longitudinally extending side frames 14, 15, interconnected by two longitudinally spaced transversely extending transoms 18, 19.

The wheels 26 are arranged in laterally spaced pairs each connected by one of the axles 22, 24 to form longitudinally spaced wheel and axle assemblies. Preferably, as illustrated, the axles 22, 24 are longitudinally spaced at equal distances from the transoms 18, 19. The truck side frames 14, 15 are rotatably supported on the ends of the front and rear axles 22, 24, respectively, atop bearing housings 30.

For powering the wheel and axle assemblies to drive the locomotive, the truck is provided with two traction motors 36, one driving each axle. Each motor is supported by conventional bearing means on its respective axle, and is carried from one of the adjacent transoms.

Self-steering action of the wheel and axle assemblies while transmitting traction and braking forces between the wheel and axle assemblies and the truck frame, is accomplished by means of a traction and steering linkage assembly formed in accordance with the invention. This traction and steering linkage assembly includes laterally extending front and rear steering beams 52, 53, respectively, which are pivotally connected at their centers with the bottom of the transoms 18, 19 respectively, as will be subsequently more fully described. The terms front and rear are used for descriptive purposes only, as the truck may be operated equally well in either direction of operation.

Opposite ends of the front and rear steering beams 52, 53 are, respectively, connected with bearing housings 30 on both ends of the front and rear axles 22, 24, respectively, by pairs of pivotally attached front and rear angled traction rods 60, 61, respectively. Steering beams 52, 53 are fixedly attached to vertically oriented tractive force shafts 48, 49 which extend vertically upward through, and are pivotally attached to, transoms 18, 19. The upper end of generally vertical tractive force shafts 48, 49 are fixedly attached to crank arms 44, 45, respectively. Diagonal link 40 oppositely and diagonally connects ends of front and rear crank arms 44, 45, respectively.

Steering beams 52, 53, angled traction rods 60, 61, crank arms 44, 45 and diagonal link 40 are so arranged as to require opposite yawing (steering) motions of the front and rear axle assemblies so as to provide inter-related, self-steering actions of the end axles. These components also comprise a force transmitting linkage which carries traction forces between the axles and the truck frame.

Angled traction rods 60, 61, are angled with respect to the central longitudinal axis of the rail truck, rather than parallel to the truck control longitudinal axis as in the prior art. From their connection point with bearing housings 30, angled traction rods 60, 61 may angle either inward or outward with respect to the longitudinal truck centerline. In the preferred embodiment, however, angled traction rods 60, 61 angle inward from bearing housings 30, as shown in the figures. When angled in either manner, the rods provide an inherent lateral stabilizing force tending to recenter an axle assembly when it is displaced laterally off of the longitudinal center line, as during hunting.

Figure 3:
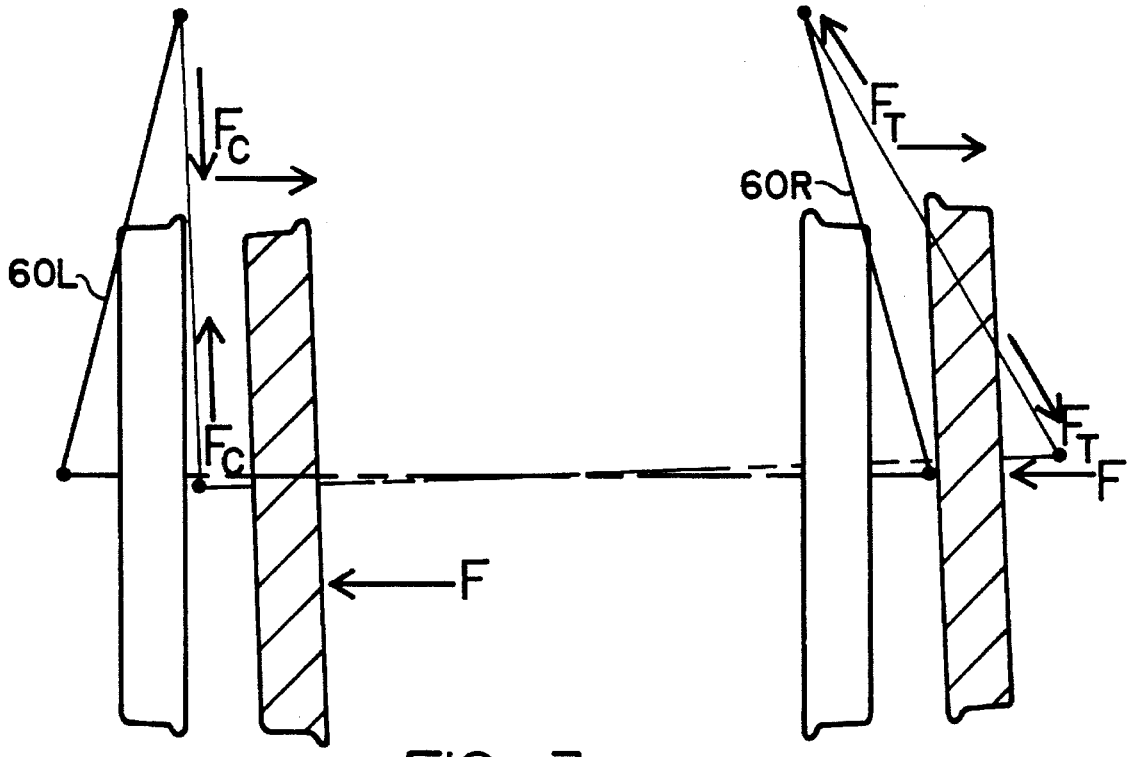
FIG. 3 is a plan view free body diagram representing an axle and wheel set of a steerable rail truck having angled traction rods of the present invention, showing the axle and wheel set longitudinally centered and showing it laterally displaced (shading).
Figure 4:
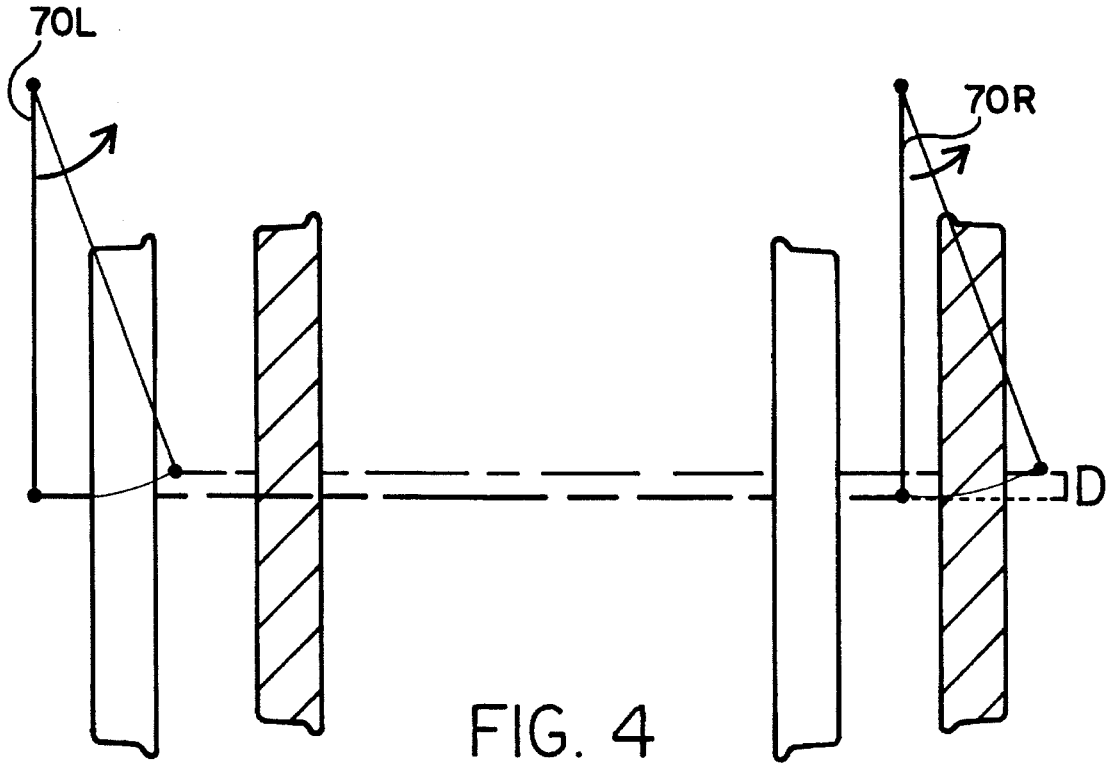
FIG. 4 is a plan view free body diagram representing an axle and wheel set of a steerable rail truck having traction rods generally parallel to the longitudinal axis of the truck, showing the axle and wheel set longitudinally centered and showing it laterally displaced (shading).

The inherent lateral stabilizing force is best explained with reference to FIGS. 3 and 4. Referring specifically to FIG. 3, for an axle and wheel set having left and right angled traction rods 60L and 60R respectively, of the present invention, when the axle assembly moves right during a hunting motion, a compression force $F_C$ is induced in left angled traction rod 60L, while a tension force $F_T$ is induced in right angled traction rod 60R. Angled traction rods 60L and 60R thus exert a counter force F tending to recenter the axle. Referring now specifically to prior art FIG. 4, for an axle and wheel set configured with traction rods 70L and 70R generally parallel to the truck longitudinal axis, because there is no compressive force induced in traction rod 70L, there is a tendency for the axle and wheel set to more easily swing out, pendulum-like, and translate longitudinally a distance denoted by D in FIG. 4. The recentering force is not induced to the same extent as with angled traction rods and the axle assembly may more easily continue to swing out and produce an aggravated hunting situation.

Figure 5:
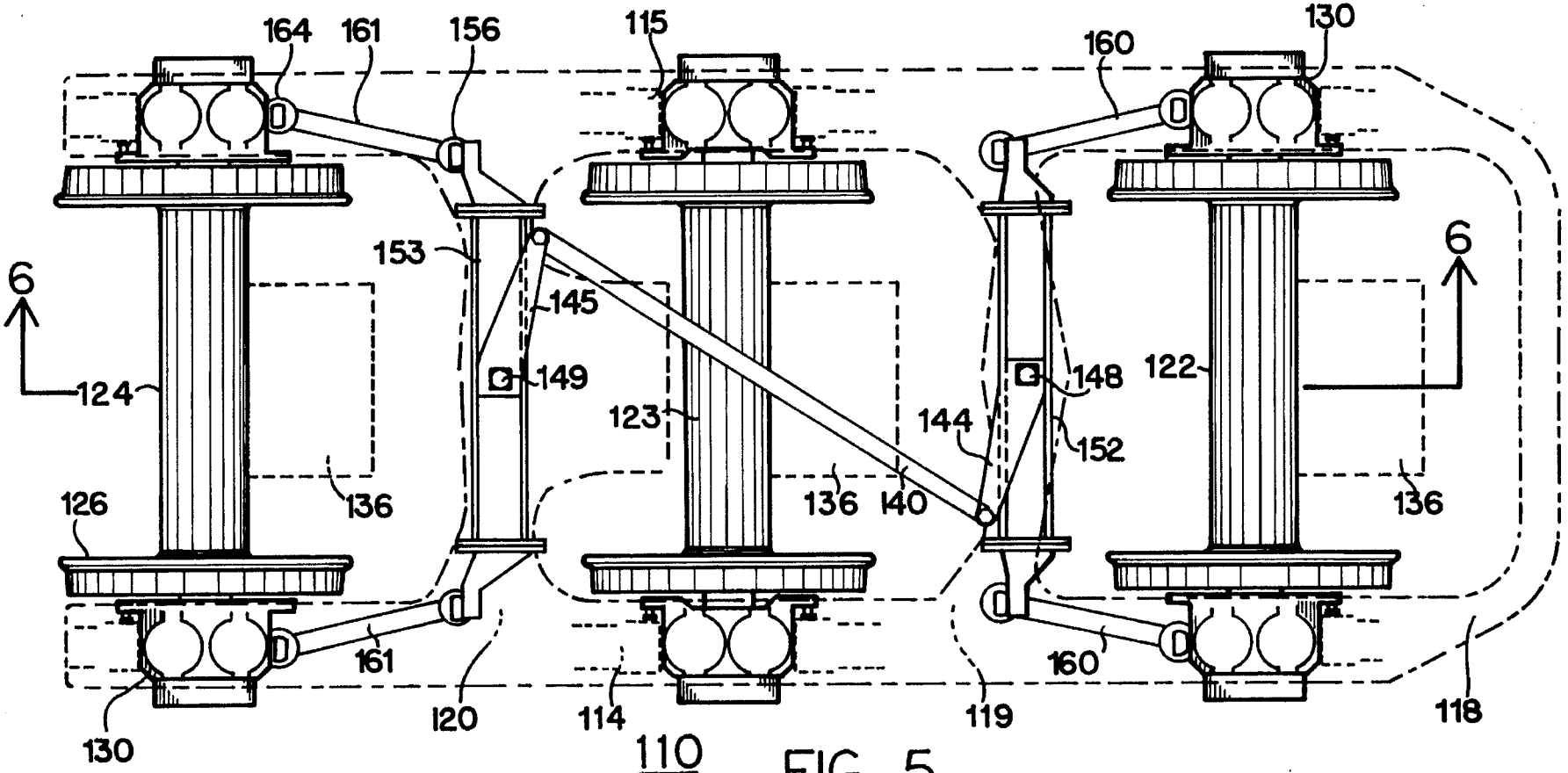
FIG. 5 is a is a plan representational view of a three axle self-steering motorized railway truck with features in accordance with the present invention with parts broken away for clarity.
Figure 6:
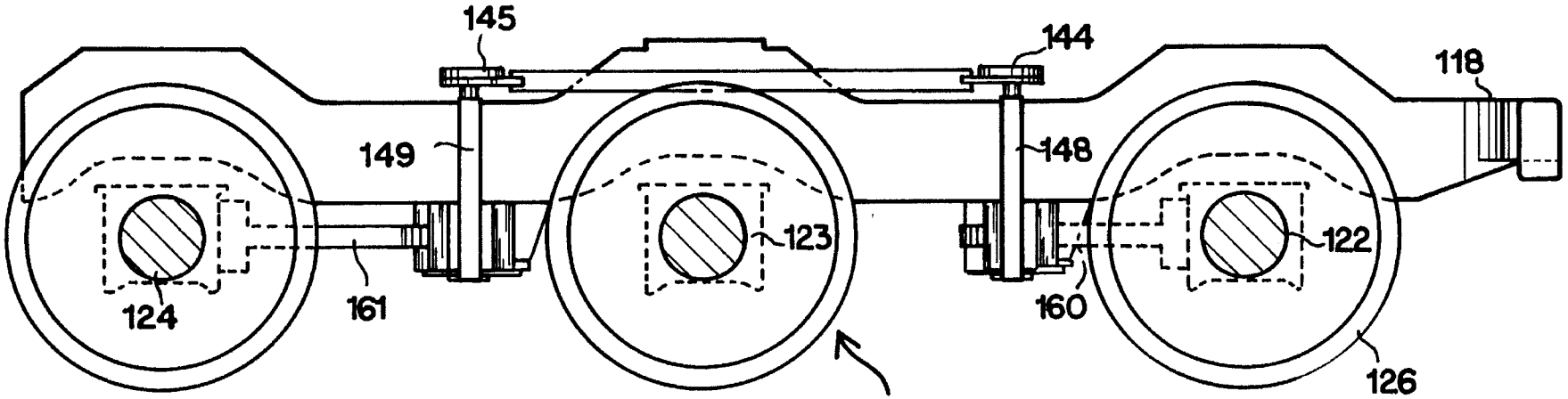
FIG. 6 is a side cross sectional representational view through line 6—6 of the truck of FIG. 5 with parts broken away for clarity.

Reference is now had to FIGS. 5 and 6, wherein a three axle embodiment of the invention is depicted. Numeral 110 generally indicates the three axle self steering railway truck of this invention. The truck 110 includes a pair of generally parallel laterally spaced longitudinally extending side frames 114, 115, interconnected by three longitudinally spaced transversely extending transoms 118, 119, 120.

The wheels 126 are arranged in laterally spaced pairs each connected by one of the axles 122, 123, 124 to form longitudinally spaced wheel and axle assemblies. Preferably, the longitudinal spacing of the wheel and axle assemblies is equal, as illustrated, and the axles 122, 123, 124 are longitudinally spaced at equal distances from the transoms 118, 119, 120. The truck side frames 114, 115 are rotatably supported on the ends of the front, center and rear axles 122, 123, 124, respectively, atop bearing housings 130.

For powering the wheel and axle assemblies to drive the locomotive, the truck is provided with three traction motors 136, one driving each axle. Each motor is supported by conventional bearing means on its respective axle, and is carried from one of the adjacent transoms.

Self-steering action of the wheel and axle assemblies while transmitting traction and braking forces between the wheel and axle assemblies and the truck frame, is accomplished by means of a traction and steering linkage assembly formed in accordance with the invention. This traction and steering linkage assembly includes laterally extending front and rear steering beams 152, 153, respectively, which are pivotally connected at their centers with the bottom of the transoms 119, 120 respectively, as will be subsequently more fully described. The terms front and rear are used for descriptive purposes only, as the truck may be operated equally well in either direction of operation.

Opposite ends of the front and rear steering beams 152, 153 are, respectively, connected with bearing housings 130 on both ends of the front and rear end axles 122, 124, respectively, by pairs of pivotally attached front and rear angled traction rods 160, 161, respectively. Steering beams 152, 153 are fixedly attached to vertically oriented tractive force shafts 148, 149 which extend vertically upward through, and are pivotally attached to, transoms 119, 120. The upper end of generally vertical tractive force shafts 148, 149 are fixedly attached to crank arms 144, 145, respectively. Diagonal link 190 oppositely and diagonally connects the ends of front and rear crank arms 144, 145, respectively.

Steering beams 152, 153, angled traction rods 160, 161, crank arms 144, 145 and diagonal link 140 are so arranged as to require opposite yawing (steering) motions of the front and rear axle assemblies so as to provide inter-related, self-steering actions of the end axles. These components also comprise a force transmitting linkage which carries traction forces between the axles and the truck frame.

Angled traction rods 160, 161, are angled with respect to, rather than parallel to, the central longitudinal axis of the rail truck. Depending on the embodiment, from their connection point with bearing housings 130, angled traction rods 160, 161 may angle either inward or outward with respect to the longitudinal truck centerline. In the preferred embodiment, however, angled traction rods 160, 161 angle inward from bearing housings 130, as shown in the figures. When angled in either manner, the rods provide an inherent lateral stabilizing force tending to recenter an axle assembly when it is displaced laterally off of the longitudinal center line, as during hunting.

The inherent lateral stabilizing force is best explained with reference to FIGS. 3 and 4. Referring specifically to FIG. 3, for an axle and wheel set having left and right angled traction rods 60L and 60R, respectively, of the present invention, when the axle assembly moves right during a hunting motion, a compression force $F_C$ is induced in left angled traction rod 60L, while a tension force $F_T$ is induced in right angled traction rod 60R. Angled traction rods 60L and 60R thus exert a counter force tending to recenter the axle. Referring now specifically to FIG. 4, for an axle and wheel set configured with traction rods 70L and 70R generally parallel to the truck longitudinal axis, because there is no compressive force induced in traction rod 70L, there is a tendency for the axle and wheel set to more easily swing out, pendulum like, and translate longitudinally a distance denoted by P in FIG. 4. The recentering force is not induced and the axle assembly may more easily continue to swing out and produce an aggravated hunting situation.

While the arrangement is disclosed in connection with self-steering trucks, it should be understood that features of the arrangement could also be applied to so called forced steering railway trucks, wherein the steering mechanism is interconnected directly with the vehicle or locomotive car body to inter-relate the steering movements of the axles with the yawing motion of the frame relative to the car body. Thus, while the described arrangement is free of direct connections between the steering linkage and the car body, the features of the invention are not so limited.

Figure 7:
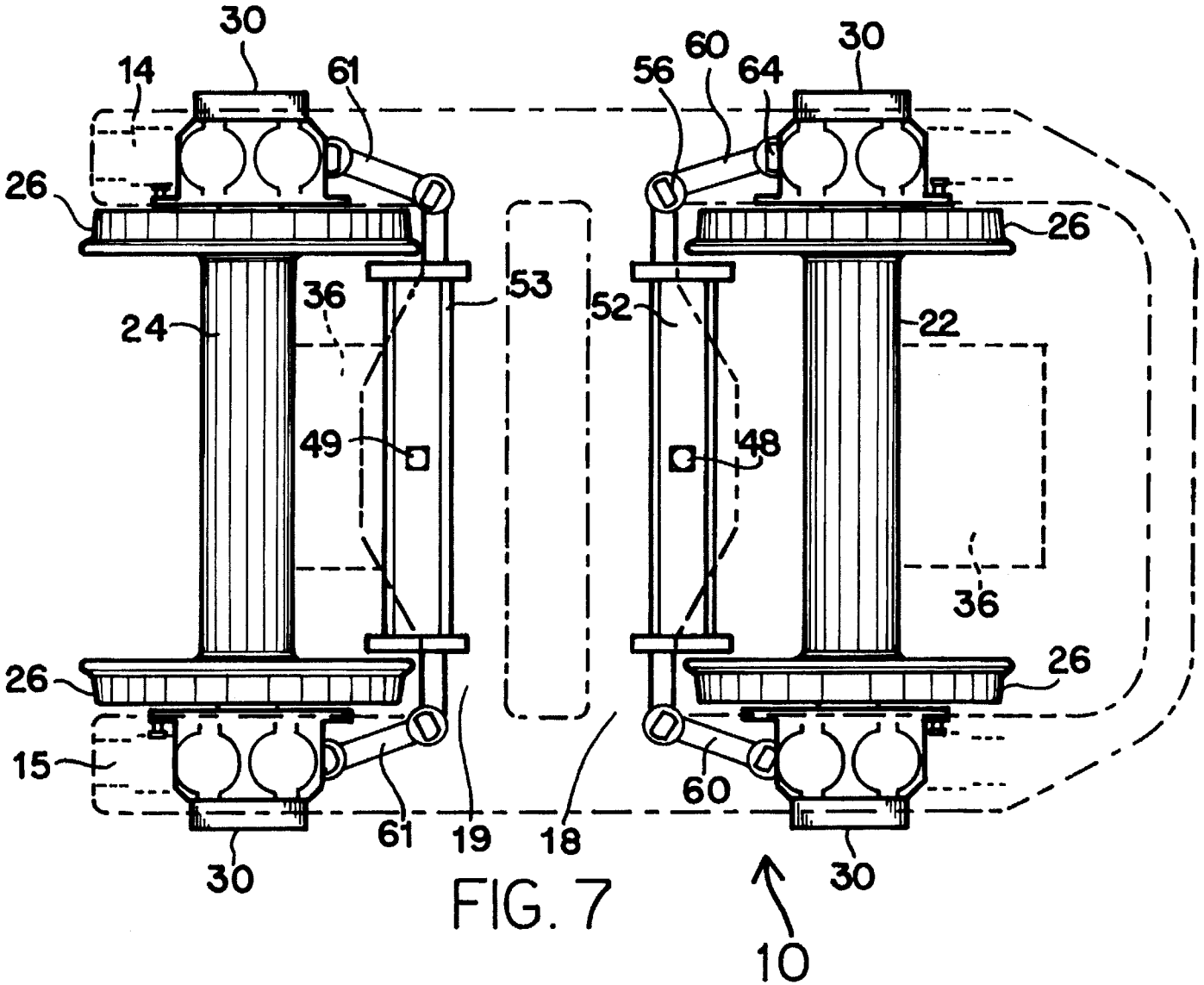
FIG. 7 is a plan view of a two axle self-steering motorized railway truck in accordance with the present invention with uncoupled axles.

Furthermore, other embodiments of the invention could be configured without diagonal link 140, so that the end axles and steering beams are not coupled, or linked. FIG. 7 depicts one such embodiment. Though the induced forced angulation effect between the axles is thereby lost, these embodiments still enjoy the other benefits described above provided by the angled traction rods 60, 61 (or 160, 161).

While the invention has been described by reference to certain preferred embodiments, it should be understood that numerous changes could be made within the sphere and scope of the inventive concepts described. Accordingly, it is intended that the invention not be limited to the disclosed embodiment, but that it have the full scope permitted by the language of the following claims.

I claim:

1. A self-steering wheel truck for use with a railway locomotive or powered transit car, said self-steering wheel truck including first and second longitudinally spaced wheel and axle assemblies each having a pair of opposing wheels interconnected by an axle, a truck frame including a pair of parallel side frames, defining a longitudinal axis, interconnected by at least two transverse frame members, defining a transverse axis, means for resiliently carrying said truck frame on said first and second axle and wheel assemblies and permitting axle yaw for both the first and second axles, tractive force motors drivedly connected to the axles for driving the wheels, an improvement which comprises;

linkage means for transferring traction forces to the truck frame;

an angled traction rod associated with each wheel interconnecting the means for rotatably carrying the truck frame on the first and second axle and wheel assemblies to the linkage means, in an orientation such that when each axle and wheel assembly is in a parallel, straight running position, each traction rod is at an angle relative to said longitudinal axis defined by the parallel side frames, wherein each said traction rod angles inwardly toward the longitudinal axis from the point where said traction rod pivotally connects to the means for rotatably carrying the truck frame on the first and second axle and wheel assemblies.

2. The self steering wheel truck of claim 1 wherein the linkage means comprises:

a pair of generally vertically oriented tractive force transmitting shafts attached to each axle and pivotally mounted to one of the transverse frame members for transmitting tractive force from the axle and wheel assembly to the truck frame and for rotation in response to axle yaw; and a diagonally disposed link connected to the first axle adjacent to a wheel and diagonally connected to the second axle adjacent to the corresponding wheel, for transmitting an opposite axle yaw inducing force to the second axle responsive to a force externally inducing self-steering yaw of the first axle.

3. The improved self-steering wheel truck of claim 2 wherein the means for connecting the vertically oriented tractive force transmitting shafts to the axle and wheel assemblies further comprises:

a pair of transversely oriented steering beams, each for positioning in fixed parallel juxtaposed relationship to an axle;

means for positioning each steering beam in fixed parallel juxtaposed relationship to an axle;

means for attaching a vertically oriented tractive force transmitting shaft to center point of each steering beam.

4. The improved self steering wheel truck of claim 1 wherein the means for rotatably carrying said truck frame on the first and second axle and wheel assemblies comprises bearing housings.

* * * * *